US005952104A

United States Patent [19]

Sugiyama et al.

[11] Patent Number: 5,952,104

[45] Date of Patent: Sep. 14, 1999

[54] INK JET RECORDING MATERIAL

[75] Inventors: Naonobu Sugiyama, Ichikawa; Kazuaki Ohshima, Yokohama; Kazuo Totani, Ichikawa; Toshiki Okayasu, Kawasaki, all of Japan

[73] Assignee: Oji Paper Co., Ltd., Tokyo, Japan

[21] Appl. No.: 08/970,539

[22] Filed: Nov. 14, 1997

[30] Foreign Application Priority Data

Nov. 21, 1996 [JP] Japan ..... 8-310516

[51] Int. Cl.[6] ..... B41M 5/00

[52] U.S. Cl. ..... 428/409; 428/195; 428/207; 428/211; 428/331; 428/480; 428/500; 428/537.5

[58] Field of Search ..... 428/195, 207, 428/211, 331, 409, 480, 500, 537.5

[56] References Cited

FOREIGN PATENT DOCUMENTS

| | | |
|---|---|---|
| 0404492A2 | 12/1990 | European Pat. Off. . |
| 0634285A1 | 1/1995 | European Pat. Off. . |
| 56-148584 | 11/1981 | Japan . |
| 58-94491 | 6/1983 | Japan . |
| 6-234268 | 8/1994 | Japan . |
| 7-67852 | 7/1995 | Japan . |

OTHER PUBLICATIONS

Database WPI, Section Ch, Week 9551, Derwent Publications Ltd., London, GB; XP002059540 and Abstract of Japanese Patent Publ. No. 07276789A (Fuji Photo Film Co.. Ltd.), Oct. 24, 1995.

Abstract of Japanese Patent Publication No. 58193185, dated Nov. 10, 1983.

Abstract of Japanese Patent Publication No. 08282091, dated Oct. 29, 1996.

*Primary Examiner*—Pamela R. Schwartz

*Attorney, Agent, or Firm*—Nikaido, Marmelstein Murray & Oram, LLP.

[57] ABSTRACT

An ink jet recording material capable of recording clear ink images having a high color density at a high speed without blotting the ink image and provided with a high surface strength has an ink receiving layer formed on a support, which may be a plastic film or a synthetic paper sheet, including synthetic amorphous silica particles and a binder, the surface of the ink receiving layer being characterized by exhibiting a peak area ratio ($C_1s/Si_2p$) of carbon electron 1s to silicon electron 2p of 6.0 to 35.0, determined by an X-ray photo-electron spectroscopy.

7 Claims, No Drawings

INK JET RECORDING MATERIAL

BACKGROUND OF THE INVENTION

1. Field of the Invention

The present invention relates to an ink jet recording material. More particularly, the present invention relates to an ink jet recording material for recording colored images and pictures with an aqueous ink.

2. Description of the Related Art

Currently, it is possible to record clear images having excellent print quality due to significant developments in ink jet color printers useful for preparing colored image hard copies at a high speed. On the other hand, to further improve the quality, saturation, appearance and clarity of the printed colored images, a new recording material having an improved performance is demanded. Especially, due to the required printing speed, resolving property, and saturation of the colored images, the recording material must have further improved performance for rapidly drying the ink, a high ink-receiving capacity, a good dot size-regulating property and a good ink blotting-inhibition property. Accordingly, various ink jet recording sheets having an ink receiving layer formed on a surface of a support sheet and provided with improved performance have been developed. For example, Japanese Unexamined Patent Publication No. 56-148,584 discloses an ink jet recording material having an ink receiving layer formed on a surface of a support and containing porous inorganic pigment particles, for example, natural zeolite, synthetic zeolite, diatomaceous earth, fine particulate silicic acid and synthetic mica pigment particles which are capable of absorbing coloring matter on the surfaces of the particles.

However, the above-mentioned type of ink jet recording material is disadvantageous in that the porous inorganic pigment particles allow the ink absorbed in the resultant ink receiving layer to diffuse and thus cause the recorded ink images to blot or spread.

To solve the above-mentioned problem, Japanese Unexamined Patent Publication No. 58-94491 proposes to add a weak acid salt of a divalent metal into the ink receiving layer, Japanese Unexamined Patent Publication No. 6-234,268 proposes to add a quaternary ammonium salt compound into the ink receiving layer, and Japanese Examined Patent Publication No. 7-67,852 proposes to use a fluorine-containing pigment particles for the ink receiving layer.

However, the ink jet recording sheets disclosed in Japanese Unexamined Patent Publication No. 58-94,491 and No. 6-234,268 and Japanese Examined Patent Publication No. 7-67,852 are disadvantageous in that since the support sheet is formed from a paper sheet comprising, as a main component, pulp fibers having a high water-absorption, when the ink receiving layer is formed from a coating liquid containing a binder resin, the binder resin is absorbed in the support sheet, and thus, after drying, the resultant ink receiving layer exhibits a low mechanical strength and is thus easily disintegrated and the ink applied to the ink receiving layer further penetrates into the support and causes the printed recording sheet to become rough.

When a plastic film is used as a support sheet, since the plastic film absorbs no ink, the ink is absorbed only in the ink receiving layer. If the ink receiving layer is formed in a small amount, the resultant receiving layer exhibits an insufficient absorption capacity for the ink and thus the absorbed ink cannot be held within the ink receiving layer and thus the ink images easily blotted. Also, if the ink receiving layer is formed in a large amount, while the ink image-blotting problem is solved, the resultant ink receiving layer exhibits a decreased peeling resistance from the support sheet and a poor resistance to disintegration.

As mentioned above, while various attempts have been made to improve the ink jet recording sheets, the resultant ink jet recording sheets are not yet satisfactory in ink blotting resistance, color clarity of recorded images and surface strength of the ink receiving layer.

SUMMARY OF THE INVENTION

An object of the present invention is to provide an ink jet recording material capable of recording ink images having a high color clarity, a clear dot appearance and a high sharpness of dot edge and useful for ink jet printers and ink jet plotters.

The above-mentioned object can be attained by the ink jet recording material of the present invention which comprises a support and an ink receiving layer formed on the support and comprising synthetic amorphous silica particles and a binder, the surface of the ink receiving layer has a peak area ratio ($C_1s/Si_2p$) of carbon electron 1s to silicon electron 2p of 6.0 to 35.0, as determined by an X-ray photo-electron spectroscopy.

In the ink jet recording material of the present invention, the support may be formed from a plastic film or synthetic paper sheet.

In the ink jet recording material of the present invention, the binder for the ink receiving layer is preferably present in an amount of 30 to 100 parts by weight per 100 parts by weight of the synthetic amorphous silica particles.

In the ink jet recording material of the present invention, the peak area ratio ($C_1s/Si_2p$) of the carbon electron 1s to the silicon electron 2p of the surface of the ink receiving layer is preferably 8.0 to 15.0.

In the ink jet recording material of the present invention, the synthetic amorphous silica particles preferably have an oil absorption of 150 to 300 ml/100 g, determined in accordance with Japanese Industrial Standard (JIS) K5101.

In the ink jet recording material of the present invention, the ink receiving layer preferably further comprises a water-soluble cationic resin.

DESCRIPTION OF THE PREFERRED EMBODIMENTS

In the present invention, the reasons why the resultant ink jet recording material exhibits an excellent ink-absorbing property, a color clarity and blotting resistance of the ink images and a high surface strength of the ink receiving layer have not yet made fully clear. However, the reasons are assumed to be as follows.

The surface of the ink jet recording material of the present invention is formed by an ink receiving layer comprising synthetic amorphous silica particles and a binder. The synthetic amorphous silica particles are porous and thus can absorb the aqueous ink, by capillary action, into the particles and the gaps between the particles. Generally, the absorption capacity of the synthetic amorphous silica particles for water or ink increases with an increase in the oil absorption of the particles. When the binder consists of a water-soluble resin, the binder is swollen by the ink and absorbs the ink therein. However, the ink absorption by the synthetic amorphous silica particles and the ink absorption by the binder are different in absorption rate from each other. Namely, the ink absorption rate of the synthetic amorphous silica particles by the capillary phenomenon is faster than the ink absorption rate of the binder by the swelling thereof. Accordingly, in the surface of the ink receiving layer comprising the synthetic amorphous silica particles and the binder, the absorption of the ink into the ink receiving layer by the capillary phenomenon of the synthetic amorphous silica particles is momently completed, and thus the water soluble resin binder in the ink receiving layer cannot fully absorb the ink therein, and therefore is not colored.

Alternatively, when the binder consists of a water-insoluble resin, the binder per se cannot absorb the aqueous ink and thus is not colored. Thus, the aqueous ink is absorbed only by the synthetic amorphous silica particles by the capillary phenomenon. However, since the water-insoluble resin occupies the gaps between the synthetic amorphous silica particles, the capillary phenomenon between the silica particles is obstructed by the binder. Therefore, the blotting of the aqueous ink absorbed by the synthetic amorphous silica particles is prevented, and the surface strength of the ink receiving layer is enhanced. Accordingly, the ink-blotting resistance, the ink image clarity and surface strength of the ink receiving layer can be controlled by adjusting the content ratio of the synthetic amorphous silica particles to the binder in the surface portion of the ink receiving layer.

The inventors of the present invention have carefully studied the content ratio of the synthetic amorphous silica particles to the binder in the ink receiving layer surface. As a result, it was found that when the peak area ratio ($C_1s/Si_2p$) of the carbon electron 1s to the silicon electron 2p is controlled to a level of 6.0 to 35.0, preferably 8.0 to 15.0, determined by an X-ray photo-electron spectroscopy, the resultant ink receiving layer of the ink jet recording material exhibited excellent ink-blotting resistance, ink image clarity and surface strength.

The X-ray photo-electron spectroscopy is useful for quantitatively and qualitatively determining a dynamic energy of a characteristic free electron released from an element atom irradiated by X-rays. Due to the characteristics of the principle of the measurement, the X-ray photo-electron spectroscopy can be applied to element atoms located only in the surface portion of 0.3 to 5.0 nm below the surface of the coating layer, but not to all the atoms located in the whole coating layer, as stated in Nihon Hyomenkagakukai, "Pictorial Book of Surface Analysis", pages 124 to 125, the Section of "X-ray Photo-Electron Spectroscopy" published by Gakkai Shuppan Center. By applying the X-ray photo-electron spectroscopy to the surface of the ink receiving layer, a peak area ratio ($C_1s/Si_2p$) of a peak area of $C_1s$ derived from carbon chain in the molecules of the binder such as the water-soluble resin to the peak area of $Si_2p$ derived from the synthetic amorphous silica can be calculated. The peak area ratio ($C_1s/Si_2p$) is utilized as an indicator of the content ratio of the binder to the synthetic amorphous silica particles in the surface portion of the ink receiving layer.

In the determination of the peak area ratio, the irradiated X rays are soft X-rays (namely X rays having a narrow energy band, for example, AlK$\alpha$ rays or MgK$\alpha$ rays).

When the peak area ratio is less than 6.0, the diffusion of the ink absorbed in the ink receiving layer by the capillary phenomenon is excessively large, and thus the configuration of the printed dots becomes fuzzy so that clear ink images having sharp edges cannot be obtained. When the peak area ratio is small, usually the content of the synthetic amorphous silica particles in the surface portion of the ink receiving layer is high and thus the recorded ink images have an enhanced color density. However there is a tendency that the ink absorbed in the ink receiving layer diffuses due to capillary action and thus the configuration of the printed dots is certainly enlarged. Also, the small peak area ratio causes the content of the binder in the surface portion of the ink receiving layer to be low, and thus the resultant ink receiving layer exhibits a decreased surface strength, is easily disintegrated and is thus unsatisfactory in practice.

On the other hand, a high peak area ratio usually causes the content of the binder in the ink receiving layer surface portion to be high, and thus a portion of the ink applied to the ink receiving layer cannot be absorbed therein and thus is not utilized for coloration of the images. Therefore, the color density of the recorded ink images certainly decreases. When the peak area ratio is more than 35.0, the portions in which the ink is not absorbed significantly increases, the configuration of the dots is distorted due to unevenness in the ink absorption, and when the ink images are printed in half tone, the resultant ink images are uneven. Due to this phenomenon, when, for example, an image of the human skin is printed, the resultant images become rough. Also, since the color density of the ink images significantly decreases, the resultant ink images look dark and dull and thus are unsatisfactory in practice.

The printing aptitude of the ink receiving layer is influenced by the content ratio of the binder to the synthetic amorphous silica particles contained in the ink receiving layer, but is not established only by the content ratio. It is important that the peak area ratio ($C_1s/Si_2p$) of the surface portion of the ink receiving layer determined by the X-ray photo-electron spectroscopic measurement, is controlled into the range of from 6.0 to 35.0, preferably from 8.0 to 15.0.

The inventors of the present invention have studied in detail the influence of the pigment and binder on the performance of the ink receiving layer and the coating conditions of the ink receiving layer. As a result, it was found that the drying conditions of the coating liquid layer for the ink receiving layer is very important to attain the object of the present invention. For example, in the drying procedure for the ink receiving layer, when the initial stage thereof is carried out at a high temperature under a strong blast condition, water in the coating liquid layer is rapidly evaporated so that the binder in the layer moves to the surface portion of the layer and is concentrated in the surface portion. As a result, the content ratio of the binder to the synthetic amorphous silica particles in the surface portion of the ink receiving layer increases. Therefore, the peak area ratio ($C_1s/Si_2p$) is increased to a level higher than the desired level of the present invention.

Therefore, in the present invention, the peak area ratio ($C_1s/Si_2p$) is preferably controlled by carrying out the initial stage of the drying procedure for the coated coating liquid layer for the ink receiving layer at a relatively low temperature and/or under a relatively weak blast condition (at a relatively low air flow rate) so as to gradually evaporate water from the coating liquid layer and to prevent the excessive concentration of the binder in the surface portion of the ink receiving layer.

Further, when a surface portion of the ink receiving layer is removed to a depth of 9 $\mu$m from the original outermost surface of the ink receiving layer, and the formed surface is subjected to a X-ray photo-electron spectroscopy, the peak area ratio ($C_1s/Si_2p$) of carbon electron $_1$s to silicon electron $_2$p is preferably 8.0 or less, more preferably 6.0 or less, still more preferably 4 or less, further preferably 3.5 or less. There is no specific lower limit of the ratio. Usually, in this case the lower limit of the peak area ratio ($C_1s/Si_2p$) is preferably about 0.2.

Where the thickness of the ink receiving layer is less than 9 $\mu$m, the surface portion of the ink receiving layer is removed at a deepness of 3 $\mu$m from the original outermost surface of the ink receiving layer, and the resultant surface is subjected to the determination of the peak area ratio ($C_1s/Si_2p$) of carbon electron $_1$s to silicon electron $_2$p thereof by the X-ray photo-electron spectroscopy. In this case, the resultant peak area ratio of the surface is smaller than that of the original outermost layer and preferably 10.0 or less, more preferably 8.0 or less, still more preferably 5.9 or less. There is no specific lower limit. In this case, usually the lower limit is preferably about 0.2.

When the peak area ratio ($C_1s/Si_2p$) of the inside portion of the ink receiving layer is too small, the content of the binder may be too small, and thus the mechanical strength of the ink receiving layer may be insufficient. When the peak area ratio ($C_1s/Si_2p$) is too large, the content of the binder may be too large, and thus the ink absorption may be too small and the blotting of the ink may become too large.

The ink receiving layer of the present invention has a surface portion in which the synthetic amorphous silica particles are located in a content contributing to enhancing the ink image-recording property of the ink receiving layer, and a bottom portion adjacent to the support surface in which the binder is present in a content contributing to enhancing the mechanical strength of the ink receiving layer.

It is known from Japanese Unexamined Patent Publication No. 58-193,185 that the ratio ($C_1s/Si_2p$) of a binder such as an aqueous resin to a synthetic amorphous silica in a surface portion of a coating layer, determined by the X-ray photo-electron spectroscopic measurement is controlled. In this prior art, the coating layer has a two-layered structure in which a water-soluble resin layer is formed on a base layer comprising, as principal components, a synthetic amorphous silica pigment and an aqueous resin. Accordingly, this prior art does not teach or suggest to control the distributions of the synthetic amorphous silica particles and the binder in a single layer structure of the ink receiving layer by controlling the drying conditions and the composition of the coating liquid for the ink receiving layer.

The synthetic amorphous silica particles usable for the ink receiving layer of the present invention may be produced by a method in which a high purity siliceous sand is mixed with sodium silicate and sulfuric acid to prepare silicic acid sol, and the silicic acid sol is converted to three-dimensional agglomerate particles; a method in which growth of secondary agglomerate particles of silica is stopped by the influence of temperature, ions and a surfactant and the particles are precipitated; or a method in which silicon tetrachloride is decomposed.

The synthetic amorphous silica particles having an oil absorption of 150 ml/100 g to 300 ml/100 g determined in accordance with Japanese Industrial Standard (JIS) K5101 are useful for the present invention, to obtain a satisfactory ink jet recording material. With respect to the reasons of the effect of the oil absorption in the range of 150 to 300 ml/100 g, it is assumed that when the oil absorption is less than 150 ml/100 g, the ink is absorbed in the gaps between the silica particles before the ink fully penetrates into the inside of the silica particles, and thus the surface of the ink receiving layer is not fully colored and the color density of the ink images certainly decreases. Also, it is assumed that when the oil absorption is more than 300 ml/100 g, the resultant silica particles cause the coating liquid for the ink receiving layer to have an increased viscosity, and thus in some coating methods, the resultant coating liquid becomes difficult to coat.

By using the synthetic amorphous silica particles for the ink receiving layer, an ink jet recording material having a high clarity of the ink images can be obtained.

As a binder usable for the ink receiving layer of the present invention, an aqueous resin binder is preferably used. The usable aqueous resin binder is selected from water-soluble resins, for example, polyvinyl alcohols, and derivatives of thereof, for example, silyl-modified polyvinyl alcohols and cation-modified polyvinyl alcohols, proteins, for example, casein and starch and starch derivatives, for example, oxidized starch; and water-insoluble resins, for example, latexes of conjugated diene polymers, for example, styrene-butadiene copolymers and methyl methacrylatebutadiene copolymers; latexes of acrylic polymers, for example, homopolymers and copolymers of acrylate esters and methacrylate esters; latexes of vinyl polymers, for example, styrene-vinyl acetate copolymers; latexes of functional carboxyl group- and cationic group-modification products of the above-mentioned polymers and copolymers.

The water-soluble resins are used in the state of an aqueous solution, and the water-insoluble resins are used in the state of an aqueous dispersion or emulsion.

The above-mentioned binders are used alone or in a mixture of two or more thereof. There is no limitation to the content of the binder in the ink receiving layer. Usually, the binder is preferably employed in an amount of 30 to 100 parts by weight per 100 parts by weight of the synthetic amorphous silica particles. If the content of the binder is too small, the resultant ink receiving layer may exhibit an unsatisfactory surface strength. Also, when the content of the binder is too large, as a whole, the resultant ink receiving layer may exhibit an insufficient ink absorption capacity and the ink-blotting phenomenon may be increased.

In the present invention, the color density of the ink images can be enhanced by adding a cationic resin to the ink receiving layer. The cationic resin usable for the ink receiving layer of the present invention is selected from, for example, water-soluble cationic resins, for example, polyethyleneimines, polyvinyl pyridines, polydialkylaminoethyl methacrylates, polydialkylaminoethyl acrylates, polydialkylaminoethyl methacrylamides, polydialkylaminoethyl acrylamides, polyepoxyamines, polyamidoamines, dicyandiamide-formaldehyde condensation products, dicyandiamidepolyalkyl-polyalkylenepolyamine condensation products, polydimethyldiallyl ammonium chloride, polyvinyl amines, and polyallylamines, and modification products of the above-mentioned compounds. The cationic resin is preferably contained in an amount of 2 to 50% by weight based on the total weight of the resin components in the ink receiving layer. When the content of the cationic resin is too small, the color density-enhancing effect on the ink images recorded in the ink receiving layer may be insufficient. If the cationic resin content is too large, the content of the binder in the ink receiving layer is decreased and thus the mechanical strength of the ink receiving layer may be insufficient.

The ink receiving layer of the present invention optionally contains various additives, for example, pigment-dispersing agents, antifoaming agents, coloring materials, antioxidants, ultraviolet ray-absorbers, viscosity-modifiers and cross-linking agents, selected in consideration of production conditions, quality of ink images and other requirements.

In the present invention, the support is preferably formed from paper sheets, plastic films, resin-coated paper sheets, synthetic paper sheet including paper-like sheet produced by forming a precursory sheet comprising a thermoplastic resin and a filler, for example, inorganic pigment, and drawing the precursory sheet so as to cause the drawn sheet to have a plurality of fine pores (voids) formed therein.

Among the above-mentioned sheet materials, plastic films and synthetic paper sheets are preferably employed to form the support. When the support is formed from plastic film or a synthetic paper sheet, the penetration of the binder into the support is restricted, the content of the binder in the bottom portion of the ink receiving layer adjacent to the support is increased, and, as a result, the mechanical strength of the ink receiving layer is enhanced and the peeling of the ink receiving layer from the support is prevented.

The pulp usable for the paper sheets can be selected from ground wood pulps, sulfite pulps, kraft pulps, semi-chemical pulps, chemi-ground pulps, refrier-ground pulps produced from soft woods, for example, Japanese red pine, Japanese black pine, silver fir, fir, and cedar woods; and hard woods, for example, Japanese beech, birch and chinquapin woods, and used paper pulps.

The paper sheets usable for the support of the ink jet recording material of the present invention, optionally contains, in addition to the above-mentioned wood pulps, a pigment for example, inorganic pigment such as clay, talc, calcium carbonate, calcined kaolin, aluminum oxide, aluminum hydroxide, and titanium dioxide, and organic pigment such as urea resin fine particles; and an additive selected from internal sizing agents, for example, rosin materials, alkylketone dimers, and alkenyl succinate, fixing agents such as aluminum sulfate and cationic starch, paper strength-enhancing agent such as polyacrylamide polymers and starch. From a pulp slurry containing the pigment and the additive, a paper sheet is produced by a conventional paper-forming machine. The paper sheet is optionally further sized with a surface sizing agent, comprising, for example, a rosin material, petroleum resin, starch and derivatives thereof such as oxidized starch, acetylated starch, hydroxyethylated starch, polyvinyl alcohols and derivatives thereof, synthetic resins such as homo-polymers and copolymers of styrene, alhid compounds, polyamide compounds, acrylic compounds, olefin compounds, maleic acid and vinyl acetate, which synthetic resins may be in the state of an aqueous emulsion, and/or a wax. To adjust the thickness, the paper sheet is optionally calendered by a conventional calender such as a machine calender or a super calender.

The plastic film usable for the support of the ink jet recording sheet of the present invention may be selected from thermoplastic polyester and polyolefin films. The polyester resin includes polyethylene terephthalate, polybutylene terephthalate and polycyclohexene terephthalate. The polyolefin resin includes polyethylene, polypropylene, ethylene-propylene copolymers, ethylene-vinyl acetate copolymers and mixtures of at least one of the above-mentioned polymers with other polymers. These thermoplastic resins may be used above or in a mixture of one or more thereof or in a mixture of at least one thereof with other polymers, for example, polystyrene, acrylate ester copolymers.

The plastic film may be oriented in longitudinal and/or transverse direction. Also, the plastic film may be produced by film-forming a mixture of a thermoplastic resin and fine inorganic particles and then biaxially drawing the film. A paper-like synthetic paper sheet is obtained. Also, a plurality of the plastic films may be laminated to provide a multi-layered film usable for the support. The multi-layered film may be a two or three layered film consisting of a core film layer and one or two paper-like synthetic paper sheet layer formed on one or two surfaces of the core layer. Also, three to five layered film having two or more plastic film layers and one or two paper-like synthetic paper sheet surface layers laminated altogether. The paper-like synthetic paper sheet is usually referred to as a synthetic paper sheet. There is no specific limitation to the opacity of the plastic film.

In the formation of the ink receiving layer, a conventional coating device, for example, a bar coater, an air knife coater, a blade coater or a gravure coater can be used. The sheet in which an ink receiving layer is formed on a support sheet can be used as it is as an ink jet recording material of the present invention. The sheet is optionally surface-smoothed by applying a treatment with a super calender or a gloss calender.

The amount of the ink receiving layer of the ink jet recording material of the present invention is established in consideration of the use of the recording material. The amount of the ink receiving layer should be adjusted to an appropriate level at which the ink-absorption property, the color density of the recorded ink images and the mechanical strength of the ink receiving layer are satisfactory. Usually, the ink receiving layer amount is in the range of from 3 to 30 g/m$^2$, preferably 5 to 20 g/m$^2$. If the ink receiving layer amount is too small, the ink absorption capacity is unsufficient, and thus the ink in the images blot, the ink images become fuzzy, the drying rate of the ink receiving layer is too slow, and the paper sheet-delivery roll of the printer is stained by the ink. If the amount of the ink receiving layer is too large, the resultant ink receiving layer has too large a thickness and exhibits a poor bonding strength to the support, and thus it is possible that the head nozzle outlet of the printer is blocked by a peeled portion of the ink receiving and the forming cost of the ink receiving layer becomes too high.

EXAMPLES

The present invention will be further explained by the following examples which are merely illustrative and do not limit the scope of the present invention in any way.

In the examples, the drying procedure was carried out by using a hot air dryer at a temperature of 110° C. for 120 seconds. The drying hot air flow velocity was measured on a surface of a sheet.

Example 1

An ink jet recording sheet was produced by coating a surface of a synthetic paper sheet containing an inorganic pigment and having a thickness of 110 $\mu$m (YUPO® FPG-110, made by OJI YUKAGOSEISHI K.K.) with a coating liquid (1) having the composition shown below by using a bar coater and drying the coating liquid layer under the drying condition (1) shown below to form an ink receiving layer having a dry amount of 15 g/m$^2$ on the synthetic paper sheet surface.

| Coating liquid (1) | |
|---|---|
| Component | Amount (Part by weight) |
| Synthetic amorphous silica(*)1 | 100 |
| Polyvinyl alcohol(*)2 | 40 |
| **Drying conditions (1)** | |
| Time between the end of the coating operation and the start of the drying operation | 10 seconds |
| Drying air flow velocity | 10 m/s |

[Note]
(*)1 . . . FINESIL ® X-37, made by Tokuyama K.K., Oil absorption: 275 ml/100 g
(*)2 . . . PVA 117, made by K.K. Kuraray

Example 2

An ink jet recording sheet was produced by the same procedures as in Example 1, except that in the drying conditions, the drying air flow velocity was changed to 30 m/s.

Example 3

An ink jet recording sheet was produced by coating a surface of a polyethylene terephthalate (PET) resin film having a thickness of 75 μm (Lumilar® T, made by K.K. Toray) with a coating liquid (2) having the composition shown below by using a bar coater and drying the coating liquid layer under the drying condition (2) shown below to form an ink receiving layer having a dry amount of 3 g/m$^2$ on the synthetic paper sheet surface.

| Coating liquid (2) | |
|---|---|
| Component | Amount (Part by weight) |
| Synthetic amorphous silica(*)3 | 100 |
| Oxidized starch(*)4 | 35 |
| Vinyl acetate copolymer latex(*)5 | 35 |
| Water-soluble cationic resin(*)6 | 10 |
| **Drying conditions (2)** | |
| Time from the end of the coating operation to the start of the drying operation | 20 seconds |
| Drying air flow velocity | 15 m/s |

[Note]
(*)3 . . . SAILICIA ® #450, made by FUJI SHILICIA K.K., Oil absorption: 200 ml/100 g
(*)4 . . . ACE ® A, made by OJI CORN STARCH K.K.
(*)5 . . . YODOSOL ® CE-58, made by KANEBO NSC K.K.
(*)6 . . . NEOFIX ® PNF-70, made by NIKKA KAGAKU K.K.

Example 4

An ink jet recording sheet was produced by the same procedures as in Example 3, except that the time between the coating operation end and the drying operation start was changed to 1 second.

Example 5

An ink jet recording sheet was produced by coating a surface of the same synthetic paper sheet as in Example 1 with a coating liquid (3) having the composition shown below by using a bar coater and drying the coating liquid layer under the drying condition (3) shown below to form an ink receiving layer having a dry amount of 30 g/m$^2$ on the synthetic paper sheet surface.

| Coating liquid (3) | |
|---|---|
| Component | Amount (Part by weight) |
| Synthetic amorphous silica (FINESIL ® X-37)(*)1 | 100 |
| Polyvinyl alcohol (PVA 117)(*)2 | 110 |
| Water-soluble cationic resin(*)7 | 10 |
| **Drying conditions (3)** | |
| Time between the coating operation end and the drying operation start | 30 seconds |
| Drying air flow velocity | 10 m/s |

[Note]
(*)7 . . . trademark: SR-1001, made by SUMITOMO KAGAKUKOGYO K.K.

Example 6

An ink jet recording sheet was produced by coating a surface of the same PET resin film as in Example 3 with a coating liquid (4) having the composition shown below by a ba coater, and drying the coating liquid layer under the drying conditions (1) to provide an ink receiving layer having a dry amount of 10 g/m$^2$.

| Coating liquid (4) | |
|---|---|
| Component | Amount (Part by weight) |
| Synthetic amorphous silica (SAILICIA ® #450)(*)3 | 100 |
| Polyvinyl alcohol(*)8 | 20 |

[Note]
(*)8 . . . PVA 117, made by Kuraray K.K.

Example 7

A wood free paper sheet having a basis weight of 82 g/m$^2$ was produced by preparing an aqueous pulp slurry by mixing 20 parts by weight of precipitated calcium carbonate to an aqueous slurry containing 100 parts by weight of hard wood bleached kraft pulp, and adding 0.8 part by weight of cationic starch, and 0.1 part by weight of anhydrous alkenyl succinic acid-containing neutral sizing agent to the above-mentioned mixture; fully stirring the pulp slurry; paper-forming the pulp slurry by using a multi-cylinder type wire paper-making machine; drying the resultant wet paper sheet to a water content of 10% by weight; applying an aqueous solution of 6% by weight of oxidized starch in a dry weight of 5 g/m$^2$ to the two surfaces of the dried paper sheet by a size press; and drying the sized paper sheet to a water content of 7%.

An ink jet recording sheet was produced by coating a surface of the above-mentioned wood free paper sheet with a coating liquid (5) having the composition shown below and drying the coating liquid layer under the drying condition (1) to form an ink receiving layer having a dry amount of 15 g/m$^2$.

| Coating liquid (5) | |
|---|---|
| Component | Amount (Part by weight) |
| Synthetic amorphous silica (FINESIL X-37)(*)1 | 65.0 |
| Polyvinyl alcohol (PVA 117)(*)2 | 35.0 |

Comparative Example 1

An ink jet recording sheet was produced by the same procedures as in Example 1, except that in the drying procedure, the drying air flow speed was changed to 50 m/s.

Comparative Example 2

An ink jet recording sheet was produced by coating a surface of the same PET resin film as in Example 3 with a coating liquid (6) having the composition shown below by using a bar coater and drying the coating liquid layer under the drying condition (1) to form an ink receiving layer having a dry amount of 20 g/m$^2$.

| Coating liquid (6) | |
|---|---|
| Component | Amount (Part by weight) |
| Synthetic amorphous silica (SAILICIA ® #450)(*)3 | 100 |
| Oxidized starch (ACEA)(*)4 | 150 |
| Water-soluble cationic resin(*)9 | 10 |

[Note]
(*)9 . . . trademark: PAS-H-5L, made by Nitto Boseki K.K.

Comparative Example 3

An ink jet recording sheet was produced by the same procedures as in Example 3, except that in the drying procedure, the time between the coating operation end and the drying operation start was changed to 1 second and the drying air flow velocity was changed to 30 m/s.

Comparative Example 4

An ink jet recording sheet was produced by the same procedures as in Example 6, except that in the drying procedure, the time between the coating operation end and the drying operation start was changed to 60 seconds.

Tests

In each of Examples 1 to 7 and Comparative Examples 1 to 4, the resultant ink jet recording sheet was subjected to the following tests.

(1) Peak Area Ratio ($C_1s/Si_2p$)

A surface of a sample of the ink jet recording sheet in a circle form having a diameter of 6 mm was subjected to measurements of peaks of carbon electron is and silicon electron 2p by an X-ray photo-electron spectrometer (model: JPS-80, made by NIHON DENSHI K.K.) under an acceleration voltage of X-ray power source of 10 kV at a current of emission power source of 10 mA, under a vacuum pressure of $5\times10^{-8}$ m bar, in a bond energy measurement range of 0 to 500 eV. Each peak area was calculated by a half-width method in which the peak area was calculated as an approximate triangle area obtained from a height of the peak and a half width of the intensity curve. Then, the peak area ratio ($C_1s/Si_2p$) was calculated from the peak areas of $C_1s$ and $Si_2p$.

The thickness of the surface portion removed from the ink receiving layer was determined from the difference between the original thickness of the ink jet recording material and the thickness of the surface portion-removed ink jet recording material. The removal of the surface portion of the ink receiving layer was carried out by using a knife made by Feather Anzenkamisori K.K., and the thickness of the ink jet recording material was measured by using a paper thickness tester in accordance with Japanese Industrial Standard P 8118.

(2) Ink Absorption Property

The ink jet recording sheet was printed with an aqueous black colored ink by an ink jet printer (Deskwriter C, made by Hewlett-Packard), and the time necessary to complete the drying of the ink images was measured.

The test result was evaluated as follows.

| Class | Drying time (D) | Ink absorption |
|---|---|---|
| 5 | D < 4 sec | Excellent |
| 4 | 4 sec ≦ D < 6 sec | Good |
| 3 | 6 sec ≦ D < 10 sec | Usable in practice |
| 2 | 10 sec ≦ D < 15 sec | Unsatisfactory |
| 1 | 15 sec ≦ D | Useless in practice |

(3) Color Brightness of Images

The ink jet recording sheet was printed with aqueous yellow, magenta and cyan-colored inks by using an ink jet printer (Deskwriter C, made by Hewlett-Packard), and the printed ink image were evaluated, by naked eye, as follows.

| Class | Color brightness |
|---|---|
| 5 | Very bright |
| 4 | Bright |
| 3 | Satisfactory for practice |
| 2 | Slightly dull |
| 1 | Dull and very unclear |

(4) Expansion Resistance of Dot

The ink jet recording sheet was printed with an aqueous magenta colored ink by using an ink jet printer (Deskwriter, made by Hewlett-Packard), and the dots of the images were observed by a zoom stereoscope at a magnification of 50 and evaluated as follows.

| Class | Dot expansion | Image clarity |
|---|---|---|
| 5 | None | Very good |
| 4 | Slight | Good |
| 3 | Small | Usable in practice |
| 2 | Large | Unsatisfactory in practice |
| 1 | Very large | Useless in practice |

(5) Form of Dots

The ink jet recording sheet was printed with an aqueous magenta colored ink by using an ink jet printer (Deskwriter C, made by Hewlett-Packard), and the form of the dots of the images was observed by a zoom stereoscope at a magnification of 50, and evaluated as follows.

| Class | Dot form |
|---|---|
| 5 | True circle, excellent |
| 4 | Approximately circle, good |
| 3 | Usable in practice |
| 2 | Unsatisfactory in practice, bad |
| 1 | Useless in practice, very bad |

(6) Surface Strength of Ink Receiving Layer

A adhesive tape (cellophane tape, made by NICHIBAN) was adhered to the surface of the ink receiving layer of the ink jet recording sheet and peeled. The result was evaluated as follows.

| Class | Surface strength |
|---|---|
| 5 | Excellent |
| 4 | Good |
| 3 | Usable in practice |
| 2 | Unsatisfactory in practice |
| 1 | Useless in practice |

The test results are shown in Table 1.

TABLE 1

| Example No. | Item | Peak area ratio ($C_1s/Si_2p$) of ink receiving layer surface | Weight ratio of silica to binder | Ink absorption | Color brightness | Expansion of dots | Form of dots | Surface strength of ink receiving layer |
|---|---|---|---|---|---|---|---|---|
| Example | 1 | 12.1 | 100/40 | 5 | 4 | 5 | 5 | 5 |
| | 2 | 20.5 | 100/40 | 5 | 4 | 5 | 4 | 5 |
| | 3 | 14.7 | 100/80 | 5 | 5 | 5 | 5 | 5 |
| | 4 | 22.3 | 100/80 | 5 | 5 | 5 | 4 | 5 |
| | 5 | 30.9 | 100/120 | 4 | 5 | 5 | 4 | 5 |
| | 6 | 6.5 | 100/20 | 5 | 4 | 4 | 5 | 4 |
| | 7 | 12.1 | 100/54 | 5 | 4 | 5 | 5 | 4 |
| Comparative Example | 1 | 38.2 | 100/40 | 4 | 1 | 5 | 1 | 5 |
| | 2 | 36.5 | 100/160 | 1 | 2 | 5 | 1 | 5 |
| | 3 | 37.7 | 100/80 | 3 | 2 | 5 | 1 | 5 |
| | 4 | 4.3 | 100/20 | 5 | 2 | 1 | 3 | 1 |

In Example 1, the peak area ratio ($C_1s/Si_2p$) of the surface formed at a depth of 3 $\mu$m from the original outermost surface of the ink receiving layer was 3.5.

Also, in Example 6, the peak area ratio ($C_1s/Si_2p$) of the surface formed at a depth of 9 $\mu$m from the original outermost surface of the ink receiving layer was 3.5.

Table 1 clearly shows that the ink jet recording sheets of Examples 1 to 7 prepared in accordance with the present invention and having a peak area ratio ($C_1s/Si_2p$) of from 6.0 to 35.0 exhibited excellent ink absorption, color brightness of ink images, resistance of dots to expansion form of dots and surface strength of the ink receiving layer, whereas the ink jet recording sheets of Comparative Examples 1 to 4 having a peak area ratio ($C_1s/Si_2p$) falling the outside of the range of 6.0 to 35.0 were unsatisfactory in at least one item of the above-mentioned properties.

The ink jet recording material of the present invention exhibits not only excellent ink absorption and color brightness of the ink images but also a high resistance to expansion of the dots, a good form of the dots, and an excellent surface strength.

Namely, the ink receiving layer of the ink jet recording material of the present invention can rapidly absorb ink; the resultant ink images exhibit a high resistance to blotting and spreading and a high color brightness; the dots in the image have a good form and sharp edges, and the surface strength of the ink receiving layer is excellent. Therefor, the ink jet recording material of the present invention can record thereon clear ink images with a high resolving power at a high speed.

We claim:

1. An ink jet recording material comprising a support and an ink receiving layer formed on the support and comprising synthetic amorphous silica particles and a binder, the surface of the ink receiving layer exhibiting a peak area ratio ($C_1s/Si_2p$) of carbon electron 1s to silicon electron 2p of 6.0 to 35.0, determined by an X-ray photo-electron spectroscopy.

2. The ink jet recording material as claimed in claim 1, wherein the support is formed from a plastic film or synthetic paper sheet.

3. The ink jet recording material as claimed in claim 1, wherein the binder in the ink receiving layer is present in an amount of 30 to 100 parts by weight per 100 parts by weight of the synthetic amorphous silica particles.

4. The ink jet recording material as claimed in claim 1, wherein the ink receiving layer further comprises a water-soluble cationic resin.

5. The ink jet recording material as claimed in claim 1 wherein, when a surface formed by removing a surface portion of the ink receiving layer, to a depth of 3 $\mu$m, from the original outermost surface of the ink receiving layer is subjected to an X-ray photo-electron spectroscopy, the surface exhibits a peak area ratio ($C_1s/Si_2p$) of carbon electron $_1$s to silicon electron $_2$p of 10.0 or less.

6. The ink jet recording material as claimed in claim 1, wherein when a surface formed by removing a surface portion of the ink receiving layer, to a depth of 9 $\mu$m, from the original outermost surface of the ink receiving layer is subjected to an X-ray photo-electron spectroscopy, the surface exhibits a peak area ratio ($C_1s/Si_2p$) of carbon electron $_1$s to silicon electron $_2$p of 8.0 or less.

7. The ink jet recording material as claimed in claim 1, wherein the peak area ratio ($C_1s/Si_2p$) of carbon electron $_1$s to silicon electron $_2$p of the surface of the ink receiving layer is 8.0 to 15.0.

* * * * *